US005603481A

United States Patent [19]

Parker et al.

[11] Patent Number: 5,603,481

[45] Date of Patent: Feb. 18, 1997

[54] FRONT PACKER FOR RAM-TYPE BLOWOUT PREVENTER

[75] Inventors: Bruce G. Parker; Eric G. Childs, both of Katy, Tex.

[73] Assignee: Cooper Cameron Corporation, Houston, Tex.

[21] Appl. No.: 590,922

[22] Filed: Jan. 24, 1996

[51] Int. Cl.[6] ..... E21B 33/06

[52] U.S. Cl. ..... 251/1.3; 277/199

[58] Field of Search ..... 251/1.3; 277/73, 277/192, 199

[56] References Cited

U.S. PATENT DOCUMENTS 4,323,256 4/1982 Miyagishima et al. .
4,398,729 8/1983 Bishop et al. .
4,541,639 9/1985 Williams, III .
5,127,623 7/1992 McDugle .
5,251,870 10/1993 Ward .

*Primary Examiner*—John C. Fox
*Attorney, Agent, or Firm*—Bush, Riddle & Jackson

[57] ABSTRACT

A ram-type blowout preventer (10) has a front packing arrangement (24) with a packer assembly (28) therein. Packer assembly (28) includes an elastomeric packer member (30) and a recess (46) defined between plates (32) and (34) adjacent elastomeric packer member (30). A replaceable wear insert (60) insertable within recess (46) has projections (74) on opposed parallel sides (66, 68) of insert (60). Projections (74) include a pair of wedge-shaped projecting portions (76, 78) which press into and deform the adjacent contacting sides (48, 50) of elastomeric packer member (30) for retaining insert (60) in position within recess (46) without any separate preformed receptacles or grooves formed in elastomeric packer member (30).

16 Claims, 3 Drawing Sheets

FIG. 1
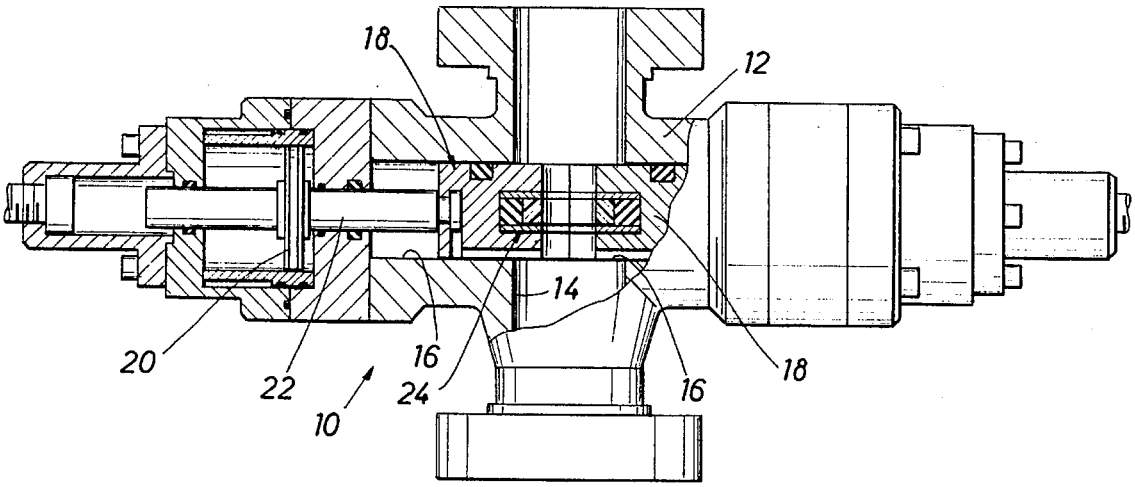
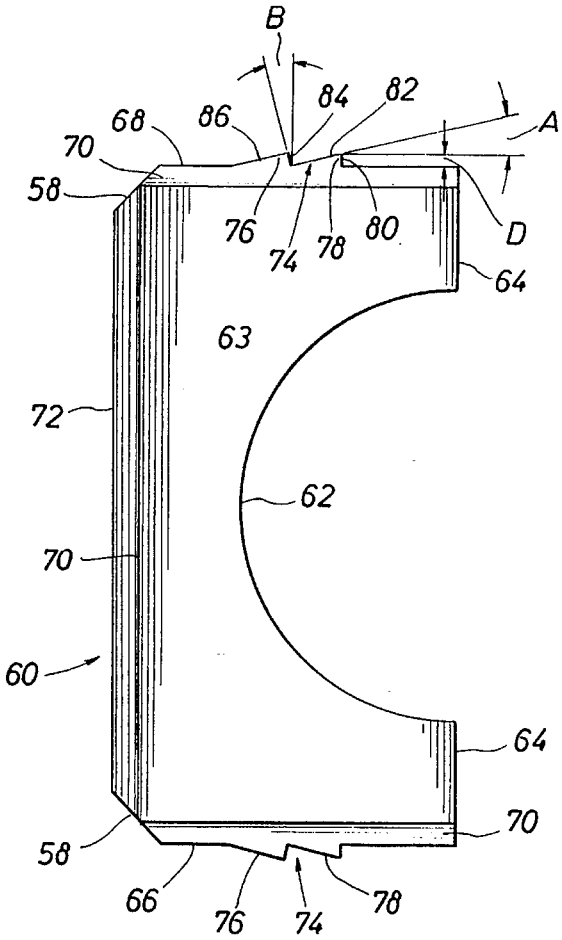
FIG. 3

FRONT PACKER FOR RAM-TYPE BLOWOUT PREVENTER

FIELD OF THE INVENTION

This invention relates to a front packer for a ram-type blowout preventer for oil and gas drilling equipment, and more particularly to a front packer having a removable wear insert for sealing lightly against a tubular member.

BACKGROUND OF THE INVENTION

Front packers are provided for ram-type blowout preventers on drilling equipment for sealing an annulus about a tubular member such as a drill pipe. A ram-type blowout preventer has two opposed ram blocks mounted for inward movement toward each other for sealing engagement with the pipe. Each ram block includes a packer formed of an elastomeric or hard rubber material for engaging the outer periphery of the pipe to form a tight seal. Each packer has a semicircular opening or recess to receive the pipe and form a tight seal about 180° of the outer periphery of the pipe.

During a stripping operation, the drill pipe is pulled from the well bore with the blowout preventer engaged against the drill pipe. Frictional contact between the blowout preventer and the pipe during stripping may result in considerable wear against the packer. For that reason, a wear insert may be added to the packer for contacting the pipe. For example, as shown in U.S. Pat. No. 4,398,729 dated Aug. 16, 1983, an insert is provided formed of a suitable resilient material which may include a nylon and/or urethane material. The combination of the packer and its insert may be called a "packer assembly". Such an insert is received within a recess in the packer. It is forcibly urged against the elastomeric packer when contacting the drill pipe under substantial fluid pressure from the ram operating piston. The insert illustrated in U.S. Pat. No. 4,398,729 includes a pair of integral outwardly extending projections. The packer is formed with a pair of coacting receptacles or grooves to receive the projections of the insert. The resilient insert is depressed inwardly when its projections are initially inserted within the receptacles in order to provide yieldable cooperation between the insert and the packer. The interfitting projections and receptacles secure the insert within the recess of the packer and prevent relative movement of the insert and the packer during rotation of the drill pipe while in frictional contact with the insert.

U.S. Pat. No. 5,127,623 dated Jul. 7, 1992 shows an insert for a front packer assembly in which an elastomeric packer member is formed with slots to receive projecting lugs of an insert to position the insert accurately within the packer member and prevent relative rotation of the insert and packer member. The insert is held in place by screws.

U.S. Pat. No. 4,541,639 dated Sep. 17, 1985 likewise shows a replaceable insert for packer assembly with projecting portions that fit into mating recesses or receptacles formed in the elastomeric packer member for retaining the insert therein.

Thus, prior means for retaining a replaceable wear insert within a recess of a front packer member have either (1) used separate retainers, such as nails or screws, extending through the insert and anchored in the adjacent elastomeric packer member or (2) employed separate preformed receptacles or recesses in the elastomeric packer member to receive projections on the insert in an interfitting relation.

SUMMARY OF THE INVENTION

The present invention is directed particularly to a front packer assembly for a ram-type blowout preventer in which a replaceable wear insert is retained within a recess of an elastomeric picker member (1) without the use of separate fasteners through the insert and (2) without the use of any separate preformed receptacles or grooves in the adjacent face of the elastomeric packer member to receive projections on the insert in mating relation to retain the insert.

Each packer member of this invention includes a front facing recess. Each packer member also includes top and bottom plates which bridge the recess of the packer member, thereby forming cavity for receiving the insert. The front facing surface of each packer member which defines the recess includes a pair of opposed generally parallel relatively smooth side surfaces connected by a relatively smooth rear surface. The smooth opposed side surfaces of the elastomeric member do not have any preformed surface irregularities, such as grooves or projections, which interfit with adjacent mating surfaces of the insert for retention of the insert within the recess.

The replaceable insert is formed of a material substantially harder than the elastomeric material the packer member. The insert has a pair of opposed sides with one or more wedge-shaped projections on each side in order to form a retainer member. Upon insertion of the insert within the recess of the packer member, the opposed wedge-shaped retainer members of the insert press or bite into and deform the adjacent facing surfaces of the elastomeric material of the packer member for retaining the insert within the recess of the packer member.

An important feature of the invention is a packer assembly including a replaceable wear insert positioned adjacent an elastomeric packer member, such insert having wedge-shaped projections which bite into and deform an adjacent front surface of the elastomeric packer member without any preformed mating grooves or receptacles in the elastomeric member for the wedge-shaped projections.

Other features and advantages of the invention will be apparent from the following specification and drawings.

BRIEF DESCRIPTION OF THE DRAWINGS

FIG. 1 is a side elevation, partly in section, of a ram-type blowout preventer including the front packer assembly which embodies the present invention;

FIG. 3 is an enlarged top plan of the replaceable wear insert removed from the packer assembly;

DESCRIPTION OF THE INVENTION

Figure 2:
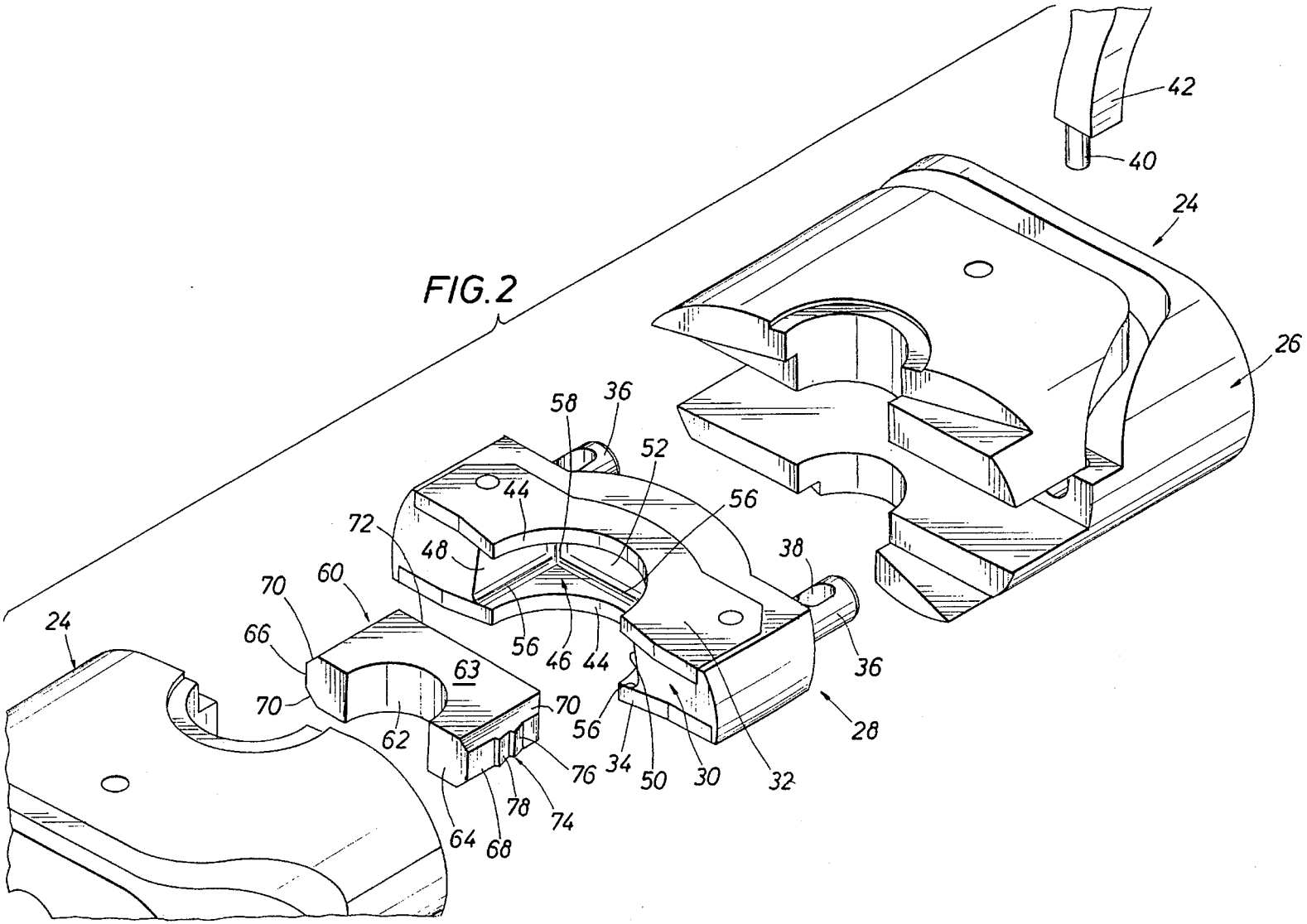
FIG. 2 is an exploded view of the front packer assembly of FIG. 1 which shows the replaceable wear insert removed from the recess in the packer member.

Referring now to the drawings for a better understanding of this invention, and more particularly to FIG. 1, a ram-type blowout preventer is shown generally at 10 having a body 12 through which a central bore 14 extends for receiving drill pipe or other oilfield tubular members. Opposed guideways 16 extend laterally outwardly from bore 14. A ram indicated generally at 18 is mounted in each guideway 16 and includes a piston 20 having a connecting rod 22 and a front packing arrangement generally indicated at 24. Packing arrangement 24 as shown particularly in FIG. 2 includes a ram body 26 having a packer assembly 28 therein. Packer assembly 28 includes an elastomeric member 30 bonded between upper and lower metal plates 32 and 34. Packer assembly 28 functions as a backing member and a sealing member. T-shaped metal retainer pins or lugs 36 secured to elastomeric member 30 have slots 38 which are engaged by pins 40 of a top seal 42 (partially shown in FIG. 2) when the packer assembly 28 is inserted within the ram body 26 of packing arrangement 24.

Packer assembly 28 includes a packer member comprising elastomeric member 30, plates 32, 34, and T-shaped pins 36 which are preferably molded together. Plates 32, 34 have semicircular openings 44 to receive a tubular member such as drill pipe (not shown). Elastomeric member 30 has a recess 46 of a generally rectangular shape between upper and lower plates 32 and 34. Recess 46 is defined between opposed generally parallel sides 48 and 50 of elastomeric member 30. Sides 48 and 50 are connected by a longitudinally extending rear side 52. Upper and lower edges or corners sides 48, 50 and 52 are chamfered at 56 as shown in FIG. 2. The junctures of sides 48 and 50 with rear side 52 are also chamfered at 58. Sides 48, 50 and 52 are generally smooth without any grooves or projections formed thereon. Elastomeric member 30 is preferably formed of a nitrilebutadiene material having a Shore A durometer hardness of about seventy (70). A material of Shore A durometer hardness between about sixty-five (65) and ninety (90) will function in a satisfactory manner. Other suitable materials for elastomeric member 30 include natural rubber, fluorocarbon rubber, neoprene, and butyl rubber for example.

Replaceable wear insert generally indicated at 60 is arranged and designed to fit within recess 46 of packer member 30 of packer assembly 28. Insert 60 as shown particularly in FIG. 3 is generally rectangular in shape and has a semicircular opening 62 between upper and lower faces 63 adapted to receive a tubular member. Front face 64 of insert 60 is positioned adjacent opening 62. Opposed planar sides 66 and 68 are essentially parallel to each other. The edges or comers 70 of sides 66 and 68 are chamfered. A rear side or face 72 connects parallel sides 66 and 68.

Formed on each side 66, 68 is a projection generally indicated at 74. Each projection 74 includes a pair of wedge-shaped projecting portions 76 and 78. FIG. 3 shows details of portions 76 and 78. Projecting portion 78 includes a planar abutment or shoulder 80 extending at right angles to the adjacent planar surface of side 66 or 68 and an inclined wedge-shaped surface 82 tapering outwardly in a forward direction at an angle A of about twelve (12) degrees with respect to the planar surface of side 66 or 68. Projecting portion 76 includes a planar abutment 84 or shoulder inclined rearwardly at an angle B of about twelve (12) degrees relative to the inclination of abutment 80. Abutment 84 is at approximately a right angle to inclined wedge surface 86 and at an angle of about seventy-eight (78) degrees relative to the planar surface of side 66 or 68. Tapered surfaces 82 and 86 are arranged in parallel relation to each other.

Projections 74 are formed particularly for biting into and deforming the adjacent smooth surfaces of parallel sides 48 and 50 defining recess 46 of member 30. See FIG. 4. When insert 60 is pressed or pushed within recess 46, tapered surfaces 82 and 86 progressively deform the elastomeric material and abutments 80 and 84 resist outward movement of insert 60 from recess 46 once insert 60 is positioned within recess 46 against rear side 52 of elastomeric member 30. Projecting portions 76, 78 extend a distance D of at least about 0.05 inch into the deformed elastomeric material in order to prevent insert 60 from movement in recess 46. If only a single projecting portion for each projection 74 is provided, it is desirable to increase distance D.

While a projection 74 is shown on each side 66, 68, it may be desirable under certain conditions to use a projection only on one side. Various shapes and locations of retaining projections may be provided on insert 60 for deforming the adjacent surface of elastomeric member 30 to retain insert 60 within recess 46. Insert 60 is preferably formed of an ultra high molecular weight (UHMW) polyethylene and is substantially rigid with a hardness of about Shore D 68. A hardness of at least about Shore D 65 is desired to provide sufficient rigidity for projections 74 for sufficiently deforming the elastomeric material of elastomeric member 30 of packer assembly 28. Other suitable materials for insert 60 may include nylon or urethane, for example.

Figure 4:
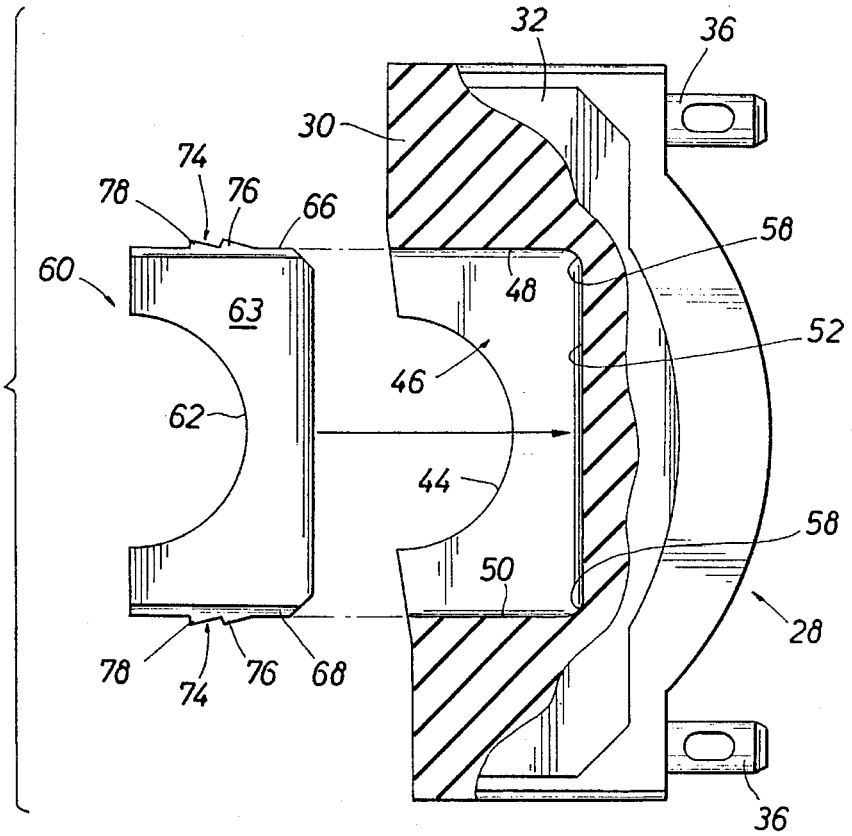
FIG. 4 is a top plan of the packer assembly with the insert removed from the recess in the packer.
Figure 6:
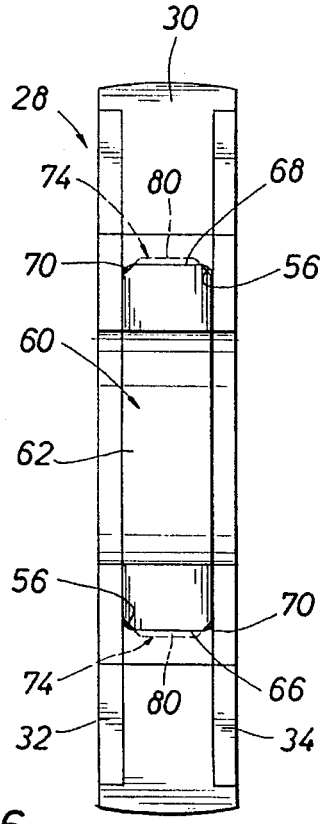
FIG. 6 is a front elevation of the packer assembly with the insert retained within the packer member.
Figure 5:
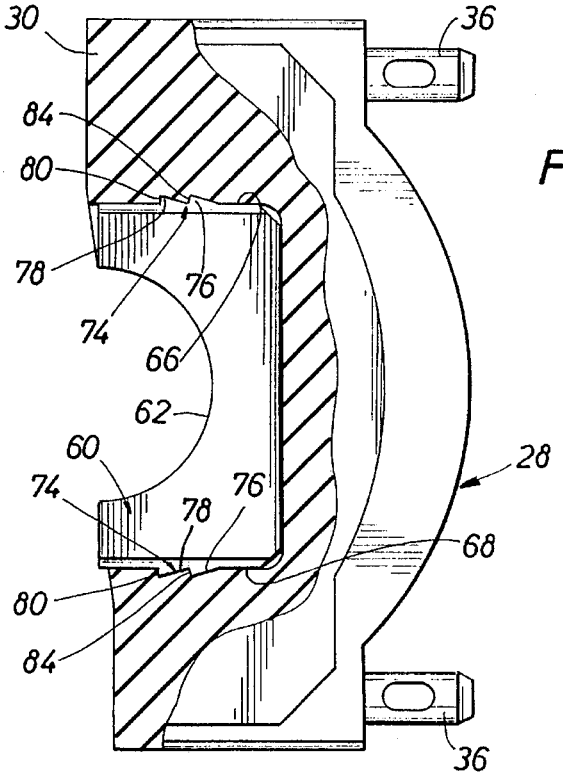
FIG. 5 is a top plan of the packer assembly with the replaceable wear insert positioned therein in a retained relation adjacent the elastomeric packer member and showing the wedge-shaped projections on the removable wear insert pressing into and deforming the adjacent elastomeric member of the packer member.

In operation, insert 60 is manually pushed within recess 46 from the position shown in FIG. 4 with opposed sides 66 and 68 in close fitting engagement with mating sides 48 and 50 of elastomeric member 30. Projecting wedge-shaped portions 76 and 78 which are generally rigid are forced into the adjacent elastomeric material of elastomeric member 30 and deform elastomeric member 30. Tapered surfaces 82 and 86 of portions 76 and 78 gradually deform elastomeric member 30 as insert 60 is pushed within recess 46 with abutments 80 and 84 projecting into elastomeric member 30 sufficiently to retain insert 60 therein during drilling operations which includes rotation of the pipe as well as stripping the pipe. Abutments 80 and 84 have a width D of 0.08 inch for insert 60). The semicircular opening 62 of insert 60 preferably has a diameter equal to the nominal diameter of the tubular member to be used in the blowout preventer for a particular operation. As an example: for a 3½ inch tubular member the diameter of opening 62 would be 3.500 inches. The semicircular opening 44 of plates 32 and 34 have a diameter which is preferably 1/16 inch larger than the diameter of the semicircular opening 62 of insert 60. Chamfers 56 on elastomeric member 30 receive chamfers 70 on insert 60 with a sufficient tolerance so that binding does not occur along the corners of insert 60 when pressed into recess 46. Insert 60 may be easily removed from recess 46 by a suitable tool, such as a screwdriver, for replacement when sufficient wear is shown by frictional engagement with the drill pipe. Upon removal of insert 60, elastomeric member 30 returns to its original shape without any permanent set resulting from deformation of the elastomeric material by projections 74. A new insert 60 may then be inserted within recess 46.

It is apparent that projections from sides 66 and 68 may be provided in a variety of shapes or designs for deforming elastomeric member 30 sufficiently to retain insert 60 within recess 46. Projections 74 have to be of a hardness greater than the hardness of elastomeric member 30 in order to bite into and deform elastomeric member 30. While two (2) separate projecting portions have been shown for each projection for retaining insert 60, it is understood that various other types of projections could be provided within the scope of this invention without the provision of any separate preformed mating receptacles or grooves in elastomeric member 30 to receive the projections on insert 60.

While a preferred embodiment of the present invention has been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A packer assembly for a ram-type blowout preventer comprising:

an elastomeric packer member having a recess therein; and an insert positioned within said recess and having an outer peripheral surface with a contacting portion thereof fitting against said elastomeric member, said insert having at least one retaining member projecting outwardly from said contacting portion of said outer peripheral surface and pressing into said elastomeric member to deform said elastomeric member for securing said insert within said recess.

2. A packer assembly as set forth in claim 1 wherein:

said retaining member is formed of a material having a hardness greater than the hardness of said elastomeric packer member for pressing into and deforming said elastomeric packer member when said insert is positioned within said recess.

3. A packer assembly as set forth in claim 2 wherein:

said retaining member is wedge-shaped and tapers outwardly of said outer peripheral surface of said insert in a direction from the rear of said recess for progressively deforming said elastomeric member in order to resist outward movement of said insert when positioned within said recess.

4. A packer assembly as set forth in claim 1 wherein:

said recess is defined by a relatively smooth surface of said elastomeric packer member contacting said insert without any-preformed receptacles in said elastomeric member to receive said retaining member.

5. A packer assembly as set forth in claim 1 wherein:

said insert has a pair of opposed sides contacting said elastomeric packer member and a retaining member is positioned on each of said sides for pressing into and deforming said elastomeric member for securing said insert within said recess without any separate preformed receptacles in said elastomeric member to receive the retaining members.

6. A packer assembly as set forth in claim 5 wherein:

said pair of opposed sides extend in a generally parallel relation to each other.

7. A packer assembly for a ram type blowout preventer comprising:

a backing portion of elastomeric material with an upper and a lower metal support plate, said backing portion having a semicircular opening therein and a recess adjacent said semicircular opening in said elastomeric material between said plates;

a replaceable wear insert within said recess fitting against said elastomeric material; and at least one retaining member projecting outwardly from said insert into said elastomeric material and having a hardness greater than the hardness of said elastomeric material for pressing into and deforming said elastomeric material for securing said insert within said recess.

8. A packer assembly for a ram type blowout preventer as set forth in claim 7 wherein:

said retaining member is wedge-shaped for progressively deforming said elastomeric material and resisting outward movement of said insert from said recess.

9. A packer assembly for a ram type blowout preventer as set forth in claim 7 wherein:

said elastomeric material has a relatively smooth surface contacting said insert without any preformed receptacles in said elastomeric material to receive said retaining member.

10. A replaceable wear insert constructed and arranged for positioning within a recess of a from packer for a ram-type blowout preventer in contact with an elastomeric material defining the recess; said replaceable wear insert comprising:

a semicircular sealing surface arranged for fitting against a pipe;

an outer peripheral surface having a contact portion thereof constructed and arranged for fitting against the elastomeric material of the packer; and a wedge-shaped retaining member projecting outwardly from said contact portion and arranged for pressing into and deforming the elastomeric material of said packer.

11. A replaceable wear insert as set forth in claim 10 wherein:

said outer peripheral surface has a pair of opposed sides, and each of said sides has a wedge-shaped retaining member projecting therefrom.

12. A replaceable wear insert as set forth in claim 10 wherein:

said wedge-shaped retaining member includes a pair of wedge-shaped portions positioned generally in end to end relation to each other.

13. In a ram-type blowout preventer including a body having a central bore therethrough and aligned guideways extending outwardly from the central bore in opposed relation, a ram in each of said guideways having a front recess, and a front packer assembly positioned in said ram front recess including an elastomeric packer member having a recess in its front face; the improvement comprising:

a removable wear insert removably positioned in said recess of said elastomeric packer member for fitting against said front face of said elastomeric packer member; said insert having a semicircular sealing face and an outer peripheral surface with a portion thereof in contact relation with said front face of said elastomeric packer member; and a retaining member projecting outwardly from said portion of said outer circumferential surface and having a hardness greater than the hardness of said elastomeric packer member pressing into and deforming said elastomeric packer member for retaining said insert within said recess without any separate preformed receptacle in said elastomeric packer member to receive said retaining member.

14. In a ram-type blowout preventer as set forth in claim 13 wherein:

said retaining member is wedge-shaped and tapers outwardly from said peripheral surface in a forward direction.

15. In a ram-type blowout preventer as set forth in claim 13 wherein:

said removable wear insert has a pair of opposed sides fitting against said elastomeric packer member, and a retaining member projects outwardly from each side.

16. In a ram-type blowout preventer as set forth in claim 15 wherein:

said opposed sides are generally planar and said elastomeric packer member has a relatively smooth surface in contact with said sides, said relatively smooth surface being deformed by the retaining members.

* * * * *